US005863261A

United States Patent [19]

Eggiman

[11] Patent Number: 5,863,261

[45] Date of Patent: Jan. 26, 1999

[54] GOLF CLUB HEAD WITH ELASTICALLY DEFORMING FACE AND BACK PLATES

[75] Inventor: Michael D. Eggiman, Hillsboro, Oreg.

[73] Assignee: Demarini Sports, Inc., Hillsboro, Oreg.

[21] Appl. No.: 625,401

[22] Filed: Mar. 27, 1996

[51] Int. Cl.[6] ..... A63B 53/04

[52] U.S. Cl. ..... 473/329; 473/345; 473/350

[58] Field of Search ..... 473/345, 346, 473/349, 350, 313, 324, 326, 329, 332, 333, 340, 342

[56] References Cited

U.S. PATENT DOCUMENTS 632,885 9/1899 Sweny ..... 473/329
1,571,109 1/1926 East .
5,083,778 1/1992 Douglass .
5,154,424 10/1992 Lo ..... 473/345 X
5,255,918 10/1993 Anderson et al. .
5,299,807 4/1994 Hutin .
5,333,861 8/1994 Mills .
5,415,398 5/1995 Eggiman .
5,431,396 7/1995 Shieh .
5,467,983 11/1995 Chen .
5,499,814 3/1996 Lu ..... 473/329
5,524,331 6/1996 Pond .

*Primary Examiner*—William H. Grieb
*Attorney, Agent, or Firm*—Klarquist Sparkman Campbell Leigh & Whinston, LLP

[57] ABSTRACT

A golf club head is disclosed having a club face comprised of a plurality of plates that act in concert to provide a spring-like response when the club impacts a golf ball. The plates are fluidly coupled by providing appropriate surfaces to the plates at their interface or by locating a viscous fluid between the plates. The plates are held in place by coupling them to the head body. One or more plates may be integrally formed with the body of the golf club head. Various parameters may be selected to optimize response or to customize the response for different golfing styles including the relative thickness of the plates, the presence of a viscous fluid between the plates, the type and viscosity of the viscous fluid, the material of the plates, (and hence, their coefficient of elasticity) and the type of mechanical coupling of the plates to the body of the golf club head.

38 Claims, 1 Drawing Sheet

GOLF CLUB HEAD WITH ELASTICALLY DEFORMING FACE AND BACK PLATES

BACKGROUND OF THE INVENTION

1. Field of the Invention

This invention pertains to the field of golf clubs.

2. Description of the Related Art

Golf is a familiar game in which players use long-shafted clubs to strike golf balls to drive them down a fairway, onto a green and into a cup located on the green. The golf "system" comprises three elements: the golfer, the golf club, and the golf ball. As noted, the present invention pertains to the golf club.

Golfers seek golf clubs that provide control and power. A superior golf club will allow a skilled golfer to hit a golf ball straight and far. The most important parameter in achieving these goals is the skill of the golfer. However, the performance of the golf club is also a significant factor. In particular, the response of the golf club due to impact with the golf ball affects the direction and range of the golf ball.

Traditionally, golf clubs are divided into two types, drivers and irons. Until recently, drivers were long shafted clubs having bulbous heads with a metal or plastic face fastened to the wood. In contrast, irons have somewhat shorter shafts and an all metal head that is often substantially planar along front and back surfaces. Irons are used for fairway shots and where substantial ball control is necessary, such as when chipping onto a green or putting.

Drivers have undergone many recent innovations including the advent of metal drivers, sometimes called "metal woods." The metal drivers have a similar shape as the traditional wood drivers, but the head size has increased. The new metal drivers are typically one-piece, cast bulbous heads having an interior cavity that some manufacturers leave empty and others fill with a foam. The use of metal gives manufacturers precise control over the quality of the product and the location of weight throughout the head, properties that were often lacking in the drivers constructed of wood.

Because of the continuing popularity of the sport, there is ongoing effort to develop clubs with superior response.

In Anderson et al., U.S. Pat. No. 5,255,918 the inventor discloses an iron that has a cast head with a rimmed recess that can receive a separately formed face plate. This permits the use of forged, hardened, face plates and easily cast bodies. In Anderson, the cast head includes a planar web that closes the back of the recess. Accordingly, when the front plate is attached to the head a substantial space is formed between the web and the face plate. As noted in the patent, the space allows the face plate 21 to deflect rearward during impact with a golf ball.

Additionally, golf shots are most effective when the ball and club meet at the club's center of percussion, defined as a point where an impulsive force can be applied with no reaction force at the point of support. An area around the center of percussion is referred to as a "sweet spot." Many research and development efforts attempt to enlarge the sweet spot so that a club is more forgiving when a ball is slightly mis-hit.

SUMMARY OF THE INVENTION

The present invention provides an improved performance golf club wherein the head includes a body that has a ball-contacting area that includes fluidly coupled plates that deform upon impact with a golf ball. The deformation causes the ball-contacting area to act as a leaf spring to effectively store energy from the impact between the golf club and the ball and then return energy to the ball as it leaves the face of the club. This returned energy provides greater distance to the ball.

The fluidly coupled plates may also enlarge the sweet spot of the club head. Further testing is required to confirm the affect of the present invention on the sweet spot.

Various advantages and features of novelty which characterize the invention are particularized in the claims forming a part hereof. However, for a better understanding of the invention and its advantages, refer to the drawings and the accompanying description in which there is illustrated and described preferred embodiments of the invention.

DETAILED DESCRIPTION OF THE PREFERRED EMBODIMENTS

Figure 1:
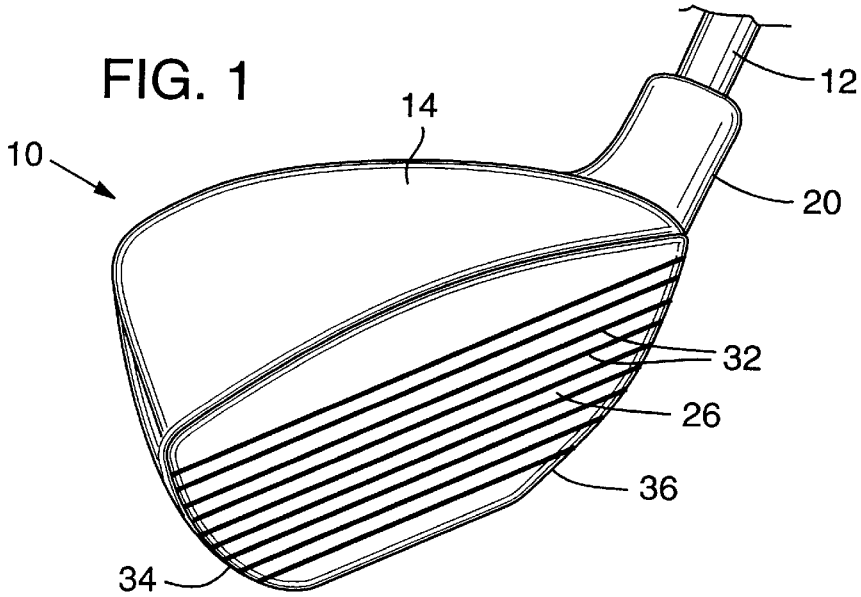
FIG. 1 is top perspective view of a golf club head of the present invention also showing a portion of a golf club shaft connected to the head.
Figure 2:
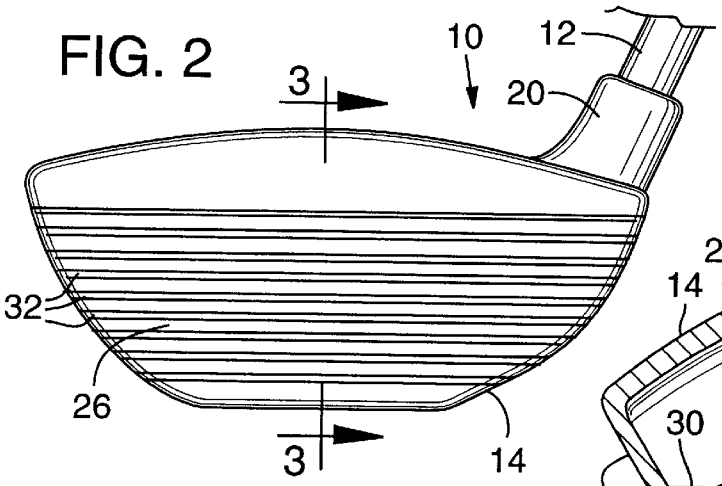
FIG. 2 is a front elevation view of a face of the golf club head of FIG. 1.
Figure 3:
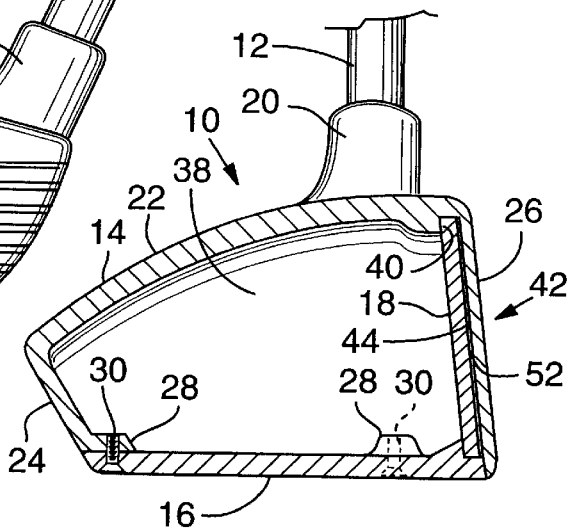
FIG. 3 is a cross section view taken along line 3—3 of FIG. 2.

FIGS. 1–3 show a first embodiment of a golf club head 10 of the present invention. The golf club head 10 is a portion of a golf club which impacts a golf ball during play. The head 10 connects to a shaft 12 that extends upward to a handle portion (not shown).

In a preferred embodiment, the head 10 includes a body 14, a bottom plate 16 and an interior, or back, plate 18.

The body 14 includes a hosel 20, a top surface 22, a back surface 24 and a face 26. The hosel 20 may be integral with, or fixedly connected to, the body 14. The hosel 20 connects the body 14, and hence the head 10, to the shaft 12. The body 14 also includes reinforced portions 28 that include threaded bores (not separately shown or numbered) for receiving bolts 30.

Preferably, the face 26 is a planar plate integrally formed with the body. The face 26 includes a plurality of flutes 32 to provide a nonslip surface for contact with a golf ball. At the outwardmost end of the head 10 is a toe 34 while the rearwardmost end is a heel 36. Accordingly, the face 26 extends from the heel 36 to the toe 34.

The bottom plate 16 is mechanically fastened to the body 14 by the bolts 30 which pass through the bottom plate and connect to the threaded bores in the reinforced portions 28. Preferably, there are at least three bolts 30 and reinforced portions 28. Only two bolts 30 and two reinforced portions 28 are visible in the cross section of FIG. 3.

The bottom plate 16 and body 14 cooperate to define a cavity 38. The cavity is completely enclosed by the body and bottom plate. However, alternative embodiments may include minor openings in the body or bottom plate. The cavity may be hollow or foam filled.

The bottom plate 16 and body 14 further cooperate to define an annular groove or channel 40 that extends around the interior periphery of the body and bottom plate near an inside surface 44 of the face 26. The back plate 18 is received within the channel 40 and held in place when the bottom plate 16 is fastened to the body 14.

The back plate 18 and face 26 cooperate to define a ball-contacting region 42 of the head 10. Preferably, the back plate 18 is substantially planar and the face 26 is a substantially planar portion of the body 14. In addition, in the preferred embodiment the back plate 18 is located substantially parallel to the planar inside surface 44 of the face 26. The back plate 18 is fluidly (or viscously) coupled to the face 26.

In its broadest sense, fluidly coupled means that the plates are located near one another, are not adhesively joined along their major, central common surfaces and react mutually to applied loads. In a somewhat more narrow sense, the plates are viscously coupled meaning that the plates are located near one another thereby defining a void between the plates and a viscous liquid is located in the void. In the preferred embodiment shown in FIGS. 1–3 the back plate 18 is held in place by the channel 40 and a liquid 46 (FIG. 4) is located between, and in contact with, the back plate 18 and the rear surface 44 of the face 26 thus viscously coupling the plates. The back plate 18 and plate face 26 are also mechanically coupled by virtue of being coupled to the body 14. Fluidic-coupling and viscous-coupling allow the plates to slide relative to one another when one or both plates are deformed. Thus, the fluidic-coupling/viscous-coupling allows the plates to react similarly to a leaf spring. Note that this reaction is contrary to laminate bodies that are adhesively coupled such as laminar beams which, due to the adhesively coupling, are rigid and decidedly not springlike.

Because the back plate 18 is captured within the channel 40 it is not free to substantially move relative to the body 14 or the face 26, except when the face or back plate are deformed. When the face 26 impacts a golf ball the force will deform the face 26 inwardly toward the cavity 38. That force will attempt to compress and move the liquid 46. However, because the time of impact is extremely small (estimated at 1/500th of a second), and because the liquid 46 is trapped between the back plate 18 and the face 26, the force of the impact will be communicated through the liquid to the back plate 18 also causing it to deform inwardly toward the cavity 38. By hitting a ball, the face 26 is deformed spherically, and the back plate 18 will deform around that spherical deformation but will have a larger radius of deformation due to the geometry by which the back plate 18 is forced to "cup" around the face 26.

It is believed to be desirable to equalize the amount of rearward deflection of the face 26 and the back plate 18. Accordingly, the geometry or physical properties, or both, will be selected to achieve substantially similar rearward deflection.

The face 26 has a thickness 48 and the back plate 18 has a thickness 50. To achieve the substantially similar rearward deflection, the thickness 48 of the face may be made more narrow than the thickness 50 of the back plate.

Alternatively, the materials of the face and back plate may be selected so that the face has a higher coefficient of elasticity than the material of the back plate 18. Empirical data may be easily collected to optimize the relationship of the thicknesses 48 and 50 and the relative coefficients of elasticity of the face 26 and the back plate 18. The current best mode comprises using the same material (and hence, the same coefficient of elasticity) for the back plate 18 and the face 26 and making the face thickness 48 somewhat more narrow than the back plate thickness 50.

Figure 4:
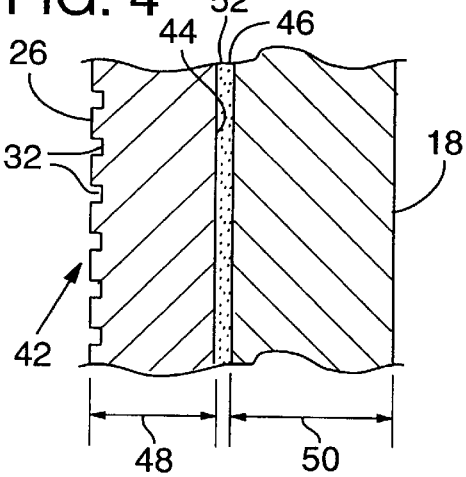
FIG. 4 is an enlarged cross section view of a portion of FIG. 3 showing a ball-contacting area of the golf club head.

In the present embodiment, as particularly shown in FIG. 4, the liquid 46 is located in a void 52 between the back plate 18 and the face 26. In preferred embodiments, the void has a width, defined as the shortest distance between the rear surface 44 and the back plate 18, of approximately 0.254 mm (0.01 inches). Satisfactory results may also be obtained with void widths as small as 0.127 mm (0.005 inches) or as large as 2.54 mm (0.10 inches).

The liquid 46 is preferably a viscous fluid such as grease, TEFLON, silicon, or other suitable fluids that will assist the back plate 18 and the face to move relative to one another without creating substantial shear stresses between the plates when the plates are deflected rearward. In a preferred embodiment the void width is 0.254 mm and the liquid 46 is a grease. Further testing may indicate other combinations of void width and fluid viscosity having optimum performance factors. In addition, manufacturability considerations may dictate different combinations.

It is noted that silicon will adhesively couple the plates. However, because silicon elastically deforms easily compared to an adhesive such as resorcinol (a common adhesive for laminer wood beams) the coupling created by silicon is a viscous coupling within the meaning of this specification.

In a form of fluidic coupling, the materials of the back plate 18 and the face 26 may have sufficiently slippery or smooth surfaces so that they are able to slide relative to one another when the face and plate are deformed rearwardly. In this alternative embodiment the fluid in the void is atmospheric air.

Figure 5:
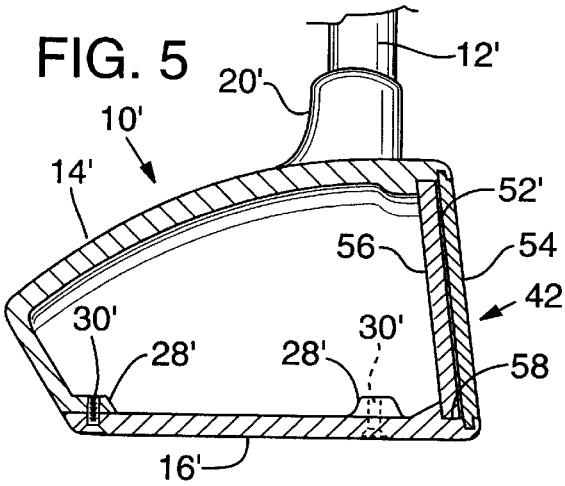
FIG. 5 is a cross section view of a second embodiment of the golf club head of the present invention.

A further embodiment of the present invention is shown in FIG. 5 which includes a body 14' and a bottom plate 16' connected to the body 14' by bolts 30' that thread into reinforced portions 28'. The body 14' further includes a hosel 20' that fixedly connects to a club shaft 12'. In this embodiment, the ball-contacting region 42 includes two substantially planar plates, a face plate 54 and an interior plate 56. Both plates are mounted in a channel 58 defined in the body 14' and the bottom plate 16'. As before, the plates 54 and 56 are viscously coupled and in the preferred embodiment, there is a void 52' between the plates having a fluid, such as liquid 46.

This second embodiment permits a greater range of selection of materials and relative thicknesses of the plates 54 and 56. In addition, the plates 54 and 56 may be custom installed at the point of sale of the golf club to accommodate different golfers.

As with the previous embodiments, the bottom plate 16' may be decoupled from the body 14' by removing the bolts 30'. Decoupling the bottom plate 16' permits the plates 54 and 56 to be removed from the head 14'. The player may then select plates 54 or 56 having different materials, different relative thicknesses, or may select a different fluid for the void 52'. The plates can then be reinserted in the channel 58 and the bottom plate 16' recoupled to the body 14'.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

What is claimed is:

1. A golf club, comprising a head having a body that defines a cavity, a toe, a heel, and a face plate, the face plate arranged to contact a golf ball when the club is properly swung by a player, the head further having a back plate located in the cavity proximate the face, the back plate and the face plate bounding a space that occupies only a portion of the cavity, the back plate being fluidly coupled to the face plate and being designed to deform elastically in response to deformation of the face plate.

2. The golf club of claim 1 wherein the face plate is integral with the body.

3. The golf club of claim 1 wherein the face plate and the back plate are formed separately from the body and are removably mounted to the body so that both the face plate and the back plate can be removed for replacement.

4. The golf club of claim 1 wherein the face plate is integral with the body and the back plate is formed separately from the body and is mechanically coupled to the body.

5. The golf club of claim 1 wherein the cavity has an interior periphery and the body further defines a groove protruding into and extending around the interior periphery of the cavity and proximate the face plate, and the back plate is partially located in the groove and held in proximity to the face plate by the groove.

6. The golf club of claim 1 wherein the body further defines a channel within the cavity and proximate the face plate and the back plate is partially located with the channel and held in proximity and substantially parallel to the face plate by the channel.

7. The golf club of claim 1 wherein the face plate and the back plate are substantially planar and located substantially parallel to one another and are separated by less than about 2.54 mm (0.1 inches).

8. The golf club of claim 1 wherein the face plate and the back plate define a void between the face plate and the back plate and further comprising grease located in the void.

9. The golf club of claim 1 wherein the face plate and back plate define a void between the face plate and the back plate and further comprising TEFLON located in the void.

10. The golf club of claim 1 wherein the face plate and the back plate define a void between face plate and back plate and further comprising a viscous fluid located in the void.

11. The golf club of claim 1 in which the face plate and back plate define a gap therebetween and are arranged so that when the face plate contacts the golf ball, at least a portion of the gap remains between the face plate and the back plate.

12. The golf club of claim 1 in which the face plate and back plate are operatively arranged such that when the face plate contacts the golf ball, the face plate elastically deforms, which causes the back plate to deform elastically also, but does not cause the face plate to contact the back plate.

13. The golf club of claim 1 in which the back plate and face plate are made of one of a metal and an alloy, and the back plate and face plate are separated by a viscous substance.

14. The golf club of claim 1 in which the back plate has two major surfaces, which are substantially planar and substantially unreinforced.

15. The golf club of claim 1 in which the plates are mounted to the body in the absence of an adhesive.

16. A golf club, comprising a head having a ball-contacting portion, the ball-contacting portion including an external plate and an internal plate, the plates being substantially planar and separated by less than about 2.54 mm (0.10 inches), the separation defining a gap between the plates, the gap being filled with a viscous fluid, and the fluid aiding the plates to move relative to one another.

17. The golf club of claim 16 wherein the external plate is integral with the head.

18. The golf club of claim 16 wherein the fluid is grease.

19. The golf club of claim 16 wherein the fluid is silicon.

20. The golf club of claim 16 wherein the head defines a cavity and further includes a detachable bottom plate, and the internal plate is located in the cavity and held in position proximate the external plate by the bottom plate when the bottom plate is mechanically fastened to the head.

21. The golf club of claim 16 wherein the head defines a cavity and further includes a detachable bottom plate, the exterior plate and interior plate being separated from one another by less than about 0.254 mm (0.01 inches) thereby defining a void between the exterior plate and the interior plate, a viscous fluid located in the void and an annular channel defined in the cavity, the interior plate being partially received in the channel and held in place by the bottom plate when the bottom plate is mechanically fastened to the head.

22. The golf club of claim 16 wherein the external plate, internal plate, and head are discrete pieces and the head defines a channel and the external plate and internal plate are partially located in the channel.

23. The golf club of claim 16 in which the head defines a cavity, the cavity being empty or filled with foam, and in which the internal plate has first and second major surfaces, the first major surface being adjacent the fluid, the second major surface being adjacent the cavity so that the internal plate encounters substantially no resistance when deforming away from the fluid into the cavity.

24. The golf club of claim 16 in which the internal and external plates are metallic.

25. A golf club, comprising a head having a ball-contacting portion, the ball-contacting portion including an external plate and an internal plate, the plates being substantially planar and separated by less than about 2.54 mm (0.10 inches) so that when the external plate elastically deforms due to impact with a golf ball the internal plate elastically deforms, and wherein the external plate has a first thickness and the internal plate has a second thickness and when the head hits a golf ball the external plate deforms a first amount and the internal plate deforms a second amount and the first thickness and second thickness are selected so that the first amount of deformation is substantially equal to the second amount of deformation.

26. The golf club of claim 25 wherein the first thickness is less than the second thickness.

27. The golf club of claim 16 wherein the head has a bottom side, the head defines a cavity that has a bottom opening extending substantially over the bottom side for providing access to the cavity, and the head further includes a detachable bottom plate that is mechanically fastened to the head to cover the bottom opening.

28. A golf club, comprising a head having a body that defines a cavity, the head including a leaf spring face having a plurality of plates fluidly coupled together for deflection in substantial unison when the face impacts a golf ball during a golf swing by a golfer, the leaf spring face temporarily storing energy imparted by the impact between the face and the golf ball and then returning the energy to the golf ball.

29. The golf club of claim 28 wherein the fluidic coupling comprises a viscous fluid located between plates that are held in close proximity.

30. The golf club of claim 28 wherein the fluidic coupling comprises grease located between plates that are mechanically coupled.

31. The golf club of claim 28 wherein the fluidic coupling comprises TEFLON located between plates that are mechanically coupled.

32. The golf club of claim 28 wherein the fluidic coupling comprises a groove defined by the body within the cavity and the plurality of plates includes a first plate that is integral with the body and a second plate that is located partially in the groove and proximate the first plate and a viscous fluid is located between, and in contact with, the first and second plates.

33. The golf club of claim 28 in which the plurality of plates are metallic.

34. The golf club of claim 28 in which each of the plurality of plates is made from the same material.

35. A golf club, comprising a head having a body that defines a cavity, a toe, a heel, and a face plate, the face plate arranged to contact a golf ball when the club is properly swung by a player and deflect in response thereto, the head further having a back plate located in the cavity proximate the face, the back plate being fluidly coupled to the face plate, the face plate and the back plate having geometries and physical properties selected so that when the golf club impacts a golf ball, the back plate deforms approximately the same amount as the face plate.

36. The golf club of claim 35 wherein the face plate and the back plate have a first and second stiffness, respectively, so that when the golf club impacts a golf ball the face plate deforms a first amount of deformation and the back plate deforms a second amount of deformation and the first and second stiffnesses are selected so that the first amount of deformation is substantially equal to the second amount of deformation.

37. The golf club of claim 35 wherein the face plate and the back plate have first and second thicknesses, respectively, and when the golf club impacts a golf ball the face plate deforms a first amount of deformation and the back plate deforms a second amount of deformation and the first and second thickness are selected so that the first amount of deformation is substantially equal to the second amount of deformation.

38. The golf club of claim 37 wherein the first thickness is less than the second thickness.

* * * * *